United States Patent [19]

Martin

[11] 4,192,163

[45] Mar. 11, 1980

[54] TOOL FOR SETTING BLIND FASTENERS

[76] Inventor: Alan Martin, 44 Lantern La., Sharon, Mass. 02067

[21] Appl. No.: 961,869

[22] Filed: Nov. 20, 1978

[51] Int. Cl.[2] ..... B21J 15/34

[52] U.S. Cl. ..... 72/114; 72/391

[58] Field of Search ..... 72/114, 391; 29/243.53

[56] References Cited

U.S. PATENT DOCUMENTS

| | | | |
|---|---|---|---|
| 2,358,703 | 9/1944 | Gookin | 72/391 |
| 2,507,740 | 5/1950 | Tincler | 72/391 |
| 3,008,598 | 11/1961 | Martin | 72/391 |
| 3,646,800 | 3/1972 | Martin | 72/391 |
| 3,768,297 | 10/1973 | Martin | 72/391 |
| 4,147,047 | 4/1979 | Fluester | 72/114 |

*Primary Examiner*—Francis S. Husar
*Assistant Examiner*—Gene P. Crosby
*Attorney, Agent, or Firm*—Wolf, Greenfield & Sacks

[57] ABSTRACT

A rivet nut setting tool having a frame with a head at one end and a grip at the other. A lever is pivotally mounted on the frame and its grip is generally parallel with the frame grip. The lever carries a threaded shaft which extends through an opening in the head. The shaft is rotated to take up the rivet nut to be set, and the grips are squeezed together to set the rivet in the work piece.

4 Claims, 4 Drawing Figures

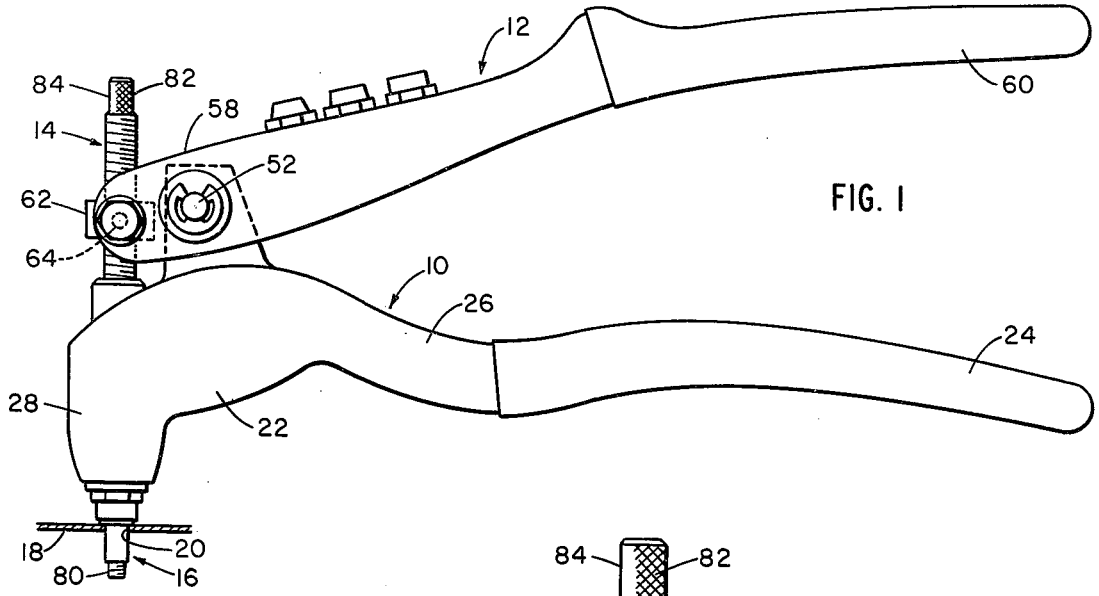
FIG. 1
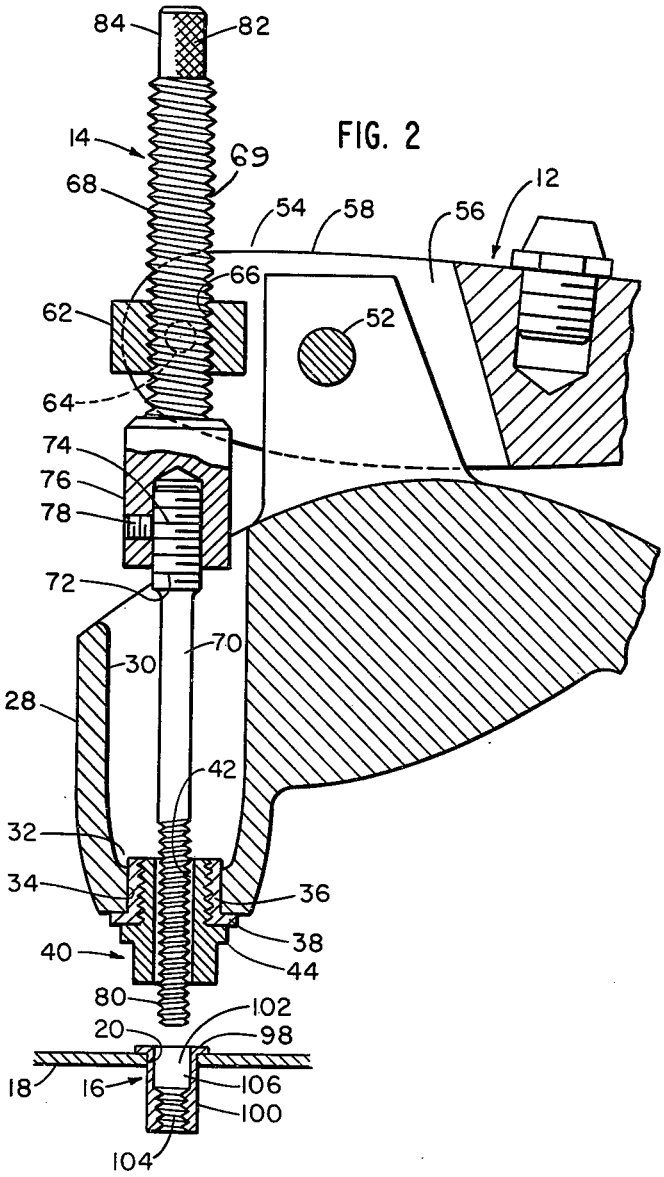
FIG. 2
FIG. 3
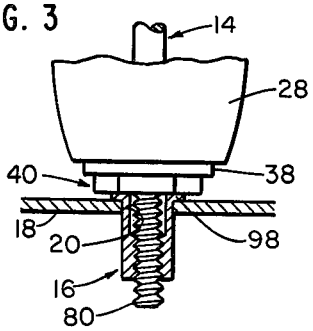
FIG. 4
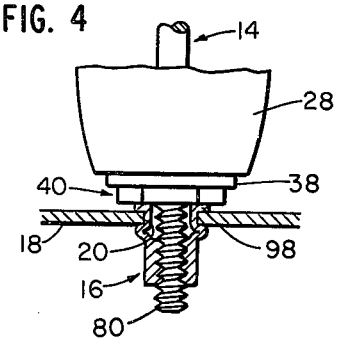

TOOL FOR SETTING BLIND FASTENERS

INTRODUCTION

This invention relates to tools for setting blind fasteners and more particularly comprises a new and improved manually operated hand tool for setting such fasteners. In the following description the features and operation of the tool are sometimes described as they apply to the setting of rivet nuts, but it is to be understood that the invention is not so limited and has broader applications.

At the present time there are a variety of blind fastener setting tools on the market. Some are very sophisticated and expensive and are wholly or semi automatic. Other available tools are very simple and inexpensive. The present invention is a very simple tool which is manually actuated but which nevertheless requires little force to operate. It is an improvement over the tool shown in my earlier U.S. Pat. No. 3,008,598 and is incorporated in a basic frame structure similar to my earlier U.S. Pat. Nos. 3,646,800 and 3,768,297.

One important object of this invention is to provide a manually operated tool which may be adjusted to accommodate the size of the hand of the user. That is, the grip spread of the handles may be varied so that maximum force may be exerted without strain or imposing an awkward manipulation upon the user.

Another important object of this invention is to provide a rivet nut setting tool which may be operated quickly to set the fastener. That is, by means of a simple squeezing action the nut may be set, rather than requiring the user to turn or twist a handle through several revolutions.

Another important object of this invention is to provide a tool fo the character described which enables the user to change the screw shaft conveniently and without taking apart the entire tool.

To accomplish these and other objects, the rivet nut setting tool of this invention includes a frame having a head at one end and a grip at the other with an opening extending through the head generally perpendicular to the grip. A pivot post on the frame carries a lever having a grip generally parallel to the grip of the frame, and the other end of the lever carries a shaft which extends through the opening in the head of the frame. The end of the shaft which extends through the head is threaded so that when the shaft is turned, it will screw into a rivet nut or other type of blind fastener. When the grips are squeezed together, the rivet nut may be set in the work, and thereafter the tool is removed by turning the shaft out of the rivet nut.

These and other objects and features of this invention will be better understood and appreciated from the following detailed description of one embodiment thereof, read in connection with the accompanying drawings.

BRIEF FIGURE DESCRIPTION

FIG. 1 is a side view of the preferred embodiment of manually operated rivet setting handle tool of this invention shown engaging a rivet nut in turn mounted in a work piece.

FIG. 2 is an enlarged fragmentary cross-sectional view of the working end of the tool shown about to engage a rivet nut in turn mounted in a work piece.

FIGS. 3 and 4 are fragmentary views of the tool and illustrating the step of setting the rivet nut in the work piece.

DETAILED DESCRIPTION

The tool shown in FIG. 1 includes generally three parts, namely, a frame 10, operating lever 12 and setting shaft 14. The tool is illustrated in association with a conventional rivet nut 16 and work piece 18 having a hole 20 in which the nut is mounted and set.

The frame 10 has a head 22 at one end and a handle grip 24 at the other end. In the orientation shown in FIG. 1, the grip is concave downwardly very slightly to accommodate the fingers when the tool is held in a conventional manner. The head 22 is connected to the grip by neck 26 so that the axis of the barrel portion 28 of the head is substantially perpendicular to the handle grip 24. A chamber 30 extends axially through the barrel portion 28, and the lower end 32 is reduced in diameter and has an opening 34 which is lined with a collar 36 which is mounted permanently in the opening. The collar 36 in turn is internally threaded as is clearly shown in FIG. 2. Collar 36 also has a flange 38 beyond the lower end 32 of opening 34, which lies against the end of the barrel.

An anvil 40 having a smooth internal bore 42 coaxial with chamber 30 is externally threaded and is removably screwed into the collar 36. Hexagonal flange 44 of the anvil lies against the flange of the collar when the anvil is in place. The anvil is replaceable with anvils having different internal bores, and the lever 12 is shown to carry a number of alternate anvils in FIG. 1. The anvil bore should bear a size relationship with the diameter of shaft 14 as is explained more fully below.

The frame 10 has as an integral part thereof a pivot post 50 on the top of head 22, and lever 12 is pivotally mounted on the post by shaft 52. The lever is bifercated at its end 54, and post 50 extends into the slot 56 created by the arms 58. Shaft 52 of course extends through post 50 and the arms 58 and may be locked in place by slotted lock washers such as suggested in FIG. 1 or by any other readily available technique.

Lever 12 has a handle grip 60 generally parallel to the grip 24 of frame 10. The tool is manipulated by squeezing the handles together as will be described presently. At the bifercated end 54 lever 12 carries a cradle-like block 62 which is pivotally mounted on pins 64 which extend into arms 58. The block has a threaded bore 66 which receives the threaded section 68 of shaft 14. It will be appreciated that because the block is pivoted about the axis of pins 64 which is perpendicular to the shaft axis, the shaft may remain substantially coaxial with the chamber 30 and bore 42 of the anvil 40. The relatively short arc through which the end 54 moves when the handles are squeezed together and the clearance of the shaft section 70 in the bore 42 avoids any binding of the shaft in the bore when the tool is actuated.

Shaft 14 as noted has sections 68 and 70. The diameter of shaft section 68 is substantially larger than section 70, and section 70 is designed to be replaced by sections of other diameter. To facilitate the replacement of shaft section 70, the shaft 12 is made in two parts, with section 70 having a threaded portion 72 which screws into the recess 74 in the collar 76 on the lower end of shaft section 68. A set screw 78 when tightened against a flat (not shown) in threaded portion 72 prevents the two shaft sections from rotating with respect to one another.

The shaft section 70 is threaded at end 80, and the direction of the threads 80 is opposite that of threads 69 on section 68. The threaded end 80 extends through the bore 42 of the anvil with sufficient clearance to allow the shaft axis to shift slightly as the lever 12 is pivoted on the frame, as suggested above. The upper end 82 of shaft 14 has a knurled handle 84 which facilitates the manual rotation of the shaft.

The manually operated tool of this invention is used to set rivet nuts in the fashion shown in FIGS. 3 and 4. The rivet nut 16 itself includes a head 98 and a cylindrical body 100 having an axial bore or opening 102 which extends through the head and body. A portion 104 of the bore 102 is threaded, and the wall thickness of the unthreaded portion 106 of the body is somewhat less than that of threaded portion 104 so that the portion 106 is somewhat weaker and subject to collapse when the rivet nut is subjected to axial compressive forces. In use the nut is mounted in an opening in the work and subsequently the portion 106 is crimped or set so that it and the head 98 form a sandwich about the work to hold the nut permanently in place. The threaded portion 104 allows a screw to secure any desired fixture to the work.

This invention provides an extremely simple and convenient tool for crimping or setting the rivet in place. In use the rivet nut may first either be placed in the hole of the work piece as in FIG. 2, or be threaded onto the end 80 and then inserted in the hole. In either case, the threaded end 80 is threaded into the rivet nut by rotating the shaft 14 by means of the knurled end 82. Because of the opposite directions of threads 69 and 80, as the end 80 screws into the rivet nut the shaft moves upwardly as viewed in the frawings to place the head 98 of the nut against the anvil 40. It will also be appreciated that threads 69 allow the spread of the handle grips to be adjusted to a comfortable distance to maximize the squeezing force the user may apply to the tool for crimping or setting the rivet. For example, if the handle spread in FIG. 1 were uncomfortable or awkward for the user and he or she wanted a wider separation of the grips, the operator need only screw the shaft deeper into the rivet nut, which would simultaneously cause the shaft to move upwardly with respect to the block 62, which effectively causes the block to move closer to the head of the frame and pivot the lever 12 on post 50 so that the handle grips spread apart. It will also be appreciated that because the shaft 14 is axially movable, its position may be adjusted to accommodate fasteners of different length and/or grip thickness.

With the grips at a comfortable spread and the head of the rivet nut against the anvil, the operator then squeezes the handles together which causes the wall section 106 of the rivet nut to crimp or set into the position of FIG. 4. With this accomplished, the operator need then only rotate the shaft by means of knurled end 82 in the opposite direction, which unscrews the end 80 of the shaft from the rivet nut. With that done, the rivet nut is ready to receive a screw to attach any desired article to the work piece in which the rivet nut is set.

As mentioned above, the tool may be modified to set rivet nuts of different diameter by changing the lower shaft section 70. When the shaft section 70 is changed, the anvil 40 should also be changed, and the appropriate size piggy-backed on the lever 12 as shown at **40*a*, 40*b* and 40*c*** should be selected.

From the foregoing description those skilled in the art will appreciate that a simple and convenient tool has been provided which accomplishes the objects of this invention. Modifications of the embodiment illustrated and described may, however, be made without departing from the spirit of the invention. Therefore, it is not my intention to limit the invention to the single embodiment shown. Rather, the scope of the invention is to be determined by the appended claims and their equivalents.

What is claimed is:

1. A blind threaded fastener setting tool comprising:

a frame having a head at one end and a grip at the other end, an opening extending through the head generally perpendicular to the grip, a pivot post on the frame adjacent the opening, a lever pivotally mounted on the pivot post and having a grip extending generally is the same direction with respect to the pivot post as the frame grip, a cradle pivotally carried by the lever on the side of the pivot post corresponding to that of the head, a shaft threaded through the cradle and extending through the opening in the head, said shaft being pulled in one direction out of the opening when the grips are squeezed together and being moved in the opposite direction when the grips are spread apart, said shaft having a threaded end portion extending through the opening in the head for screwing into a blind threaded fastener, the threads on the threaded end being opposite to the threads of the shaft threaded into the cradle, said shaft moving axially through the cradle when the shaft is rotated about its axis to screw into an internally threaded fastener, and means on the shaft at its end opposite the threaded end for rotating the shaft in the cradle to screw into the fastener and to cause the shaft to move axially in the head opening so as to vary the amount the threaded end extends out of said opening.

2. A tool as defined in claim 1 further characterized by the threads on the end portion of the shaft being right handed, and an anvil carried on the head and having an unthreaded opening there through aligned with the opening in the head, said shaft extending through the opening in the anvil.

3. A tool as defined in claim 2 further characterized by said shaft being made in at least two sections with the threaded portions lying on separate sections, and means for detatching the section carrying the threads on the end of the shaft and substituting therefor another section of different diameter.

4. A tool as defined in claim 1 further characterized by said shaft being made in at least two sections with the threaded portions lying on separate sections, and means for detatching the section carrying the threads on the end of the shaft and substituting therefor another section of different diameter.

* * * * *